US005427340A

United States Patent [19]

Stromsmoe et al.

[11] Patent Number: 5,427,340

[45] Date of Patent: Jun. 27, 1995

[54] BAG HOLDER

[75] Inventors: Mylo Stromsmoe; James D. Edwards, both of Lethbridge, Canada

[73] Assignee: Davgra Holdings Ltd., Lethbridge, Canada

[21] Appl. No.: 162,281

[22] Filed: Dec. 7, 1993

[51] Int. Cl.[6] ..... A63B 55/04

[52] U.S. Cl. ..... 248/97; 248/99; 248/175

[58] Field of Search ..... 248/97, 99, 101, 95, 248/153, 175; 141/314

[56] References Cited

U.S. PATENT DOCUMENTS

| | | | |
|---|---|---|---|
| 4,174,085 | 11/1979 | Ferreira et al. | 248/99 X |
| 4,467,989 | 8/1984 | Stroh | 248/99 X |
| 4,667,912 | 5/1987 | DeVilbiss | 248/97 |
| 4,893,769 | 1/1990 | Rotelli | 248/97 |
| 4,921,193 | 5/1990 | Benesch | 248/99 X |
| 5,172,824 | 12/1992 | Stutler | 248/101 X |
| 5,263,672 | 11/1993 | He | 248/99 X |

FOREIGN PATENT DOCUMENTS

| | | |
|---|---|---|
| 2069685 | 5/1992 | Canada . |
| 2070528 | 6/1992 | Canada . |
| 2098048 | 6/1993 | Canada . |

*Primary Examiner*—Ramon O. Ramirez
*Attorney, Agent, or Firm*—Hoffman, Wasson & Gitler

[57] ABSTRACT

There is described an improved apparatus for holding a liner or bag in an open condition, comprising a ground-engaging base and opposed frames adapted to extend upwardly from the base for supporting the liner therefrom, the frames being sufficiently spaced apart that attachment of the liner causes biasing of liner engaging portions of the frames against the liner for tensioning it into an open condition.

11 Claims, 2 Drawing Sheets

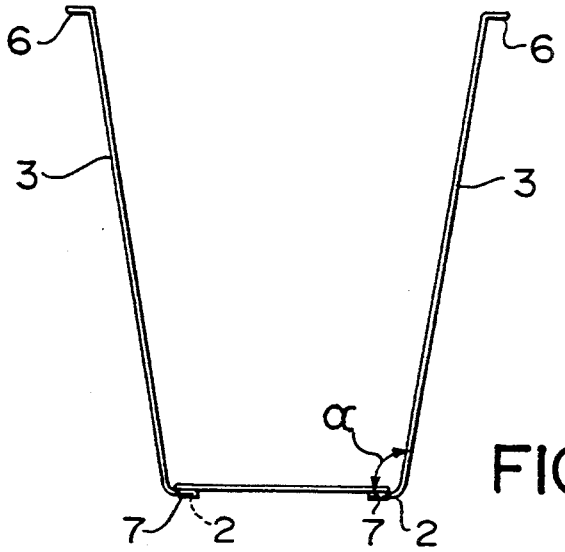
FIG. 2
FIG. 3
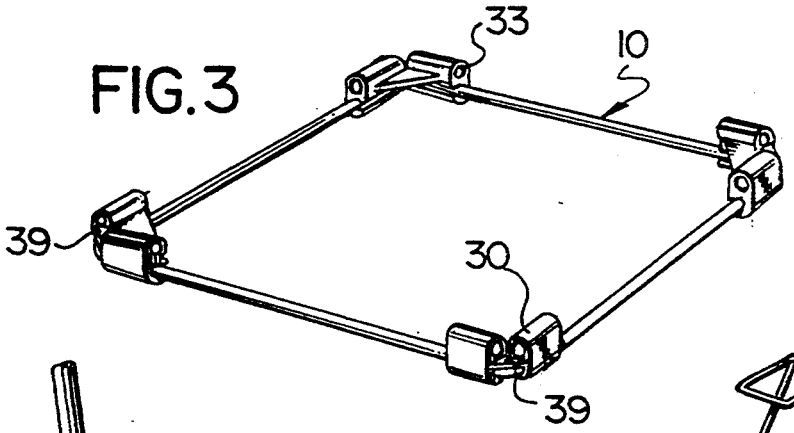
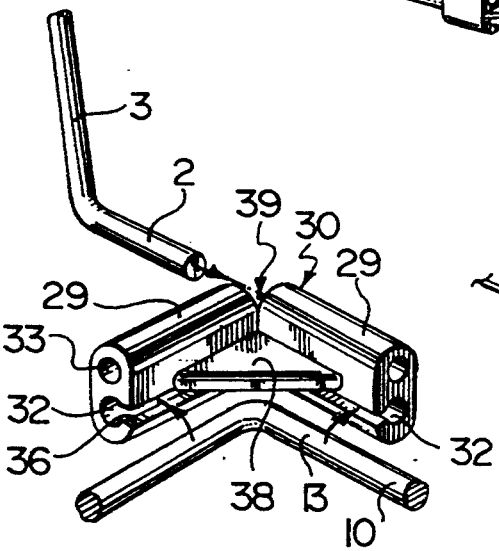
FIG. 4
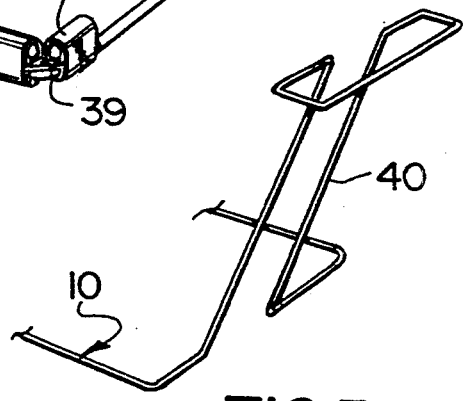
FIG. 5

BAG HOLDER

FIELD OF THE INVENTION

The present invention relates to a bag holder, and more particularly to a flexible and collapsible bag holder for use with flexible liners and bags.

BACKGROUND OF THE INVENTION

The bag holder of the present invention is primarily intended for use with flexible liners with dimensions measuring 26 inches (66.04 cm) in width by 36 inches (91.44 cm) in length or 30 inches (76.20 cm) in width by 48 inches (121.92 cm) in length.

In general, bag holders that support flexible liners and bags merely suspend the bag from its open end. No pressure is applied to the opening's periphery to better maintain the bag in a fully open condition and to prevent disengagement from the holder as the bag's load increases. It is therefore necessary to use clothespins or other types of clips, which typically are not sold with the bag holder, to hold the bag in place. Moving the holder from place to place such as when doing yard work is also awkward and difficult. Bag holders generally speaking provide no support for the bottom of the bag so that lifting the holder by the rim will usually result in the bag's pulling away or ripping. As well, some prior bag holders consist of two rectangular frames pivotally connected together at or near their centres so that when seen from the side, the holder is generally "X" shaped, with the bag hanging inside this framework. The bag cannot be removed therefore when full simply by moving it sideways relative to the frame. Either the frame must be lifted away or the bag itself must be hoisted through the frame's top opening which can be difficult due to the bag's weight. Moreover, as the bags tend to bulge and expand in size as they fill up, the bags must sometimes be removed forcibly through the holder's opening, causing ripping and spilling of the contents.

SUMMARY OF THE INVENTION

It is an object of the present invention to provide an improved bag holder that obviates and mitigates from the disadvantages of the prior art.

It is a further object of the present invention to provide a bag holder that is simple, compact and convenient to use and applies sufficient pressure to maintain the liner's opening in a fully opened condition and which also helps prevent disengagement as the liner fills up. In a preferred embodiment, the framework of the present bag holder does not impede the bag's removal when full.

According to the present invention then, there is provided an apparatus for holding a liner or bag in an open condition, comprising a ground engaging base member and opposed frame members adapted to extend upwardly from said base member for supporting a liner therefrom, said frame members being sufficiently spaced that attachment Of a liner causes biassing of liner engaging portions of said frame members against the liner for tensioning the same into an open condition.

BRIEF DESCRIPTION OF THE DRAWINGS

Preferred embodiments of the present invention will now be described in greater detail with reference to the accompanying drawings, in which:

FIG. 2 is a side elevational view of the bag holder in an assembled condition;

FIG 3 is a perspective view of a modified base for the bag holder of FIG. 1;

FIG 4 is an enlarged perspective view of part of the base of FIG. 3; and FIG. 5 is a perspective view of a further modification to the bag holder of FIG. 1.

DETAILED DESCRIPTION

Figure 1:
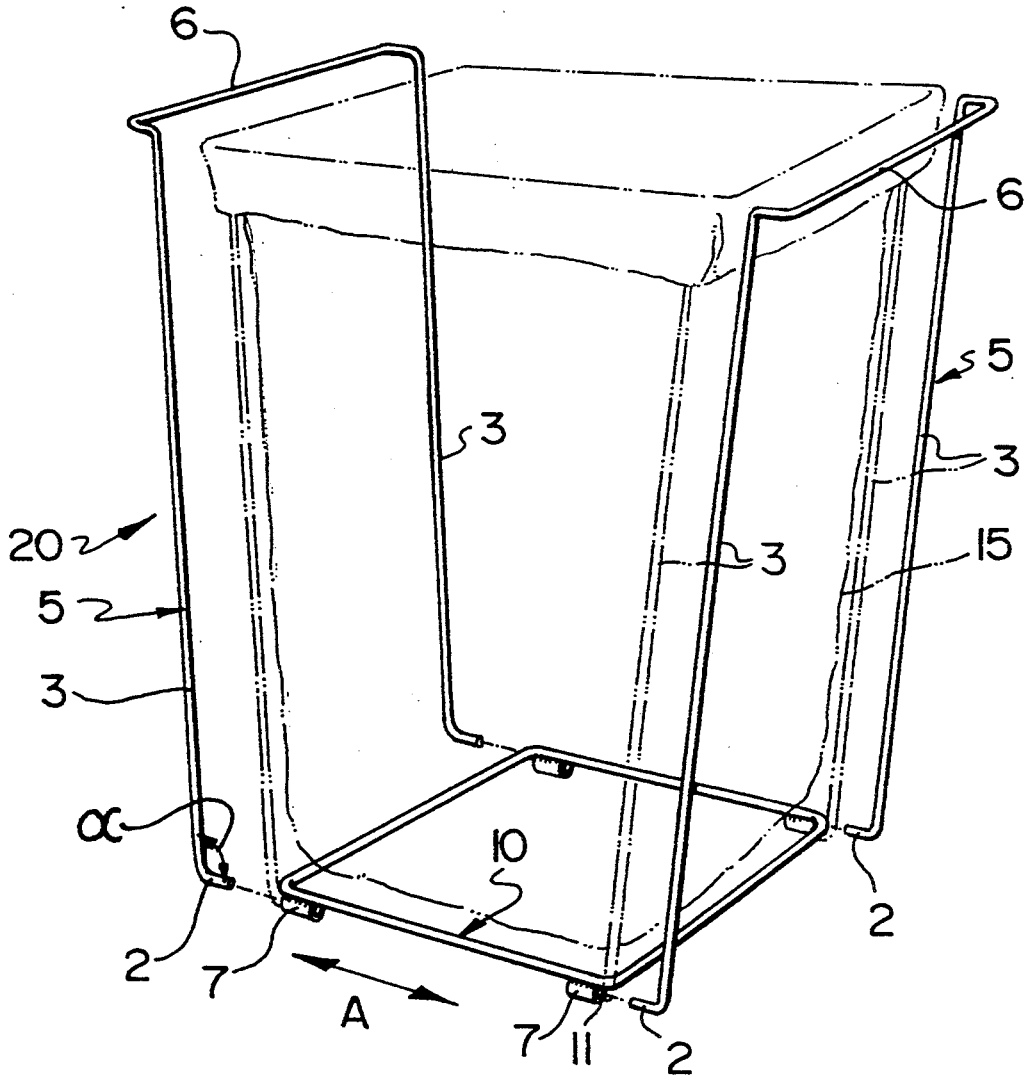
FIG. 1 is an exploded, perspective view of a flexible bag holder in accordance with the present invention.

With reference to the figures, bag holder 20 generally comprises a pair of spaced apart opposed side frames 5 and a squared or rectangular base 10 to which the side frames are detachably connected. The base and particularly the side frames are each preferably made of a strong, durable springy material such as alloyed solid steel wire.

Each of frames 5 is generally inverted-U shaped with an out-turned portion at the top defining a lip or flange 6 adapted to engage the opening of a bag or liner 15 (shown in phantom lines), uprights 3 and in-turned toes 2. The angle $\alpha$ between toes 2 and upright 3 exceeds 90° so that the frames, when connected to base 10 as will be described below, are normally splayed slightly outwardly as best seen from the side view of FIG. 2.

Base 10 includes at each of its corners 11 a tubular bracket 7 that acts both as a ground-engaging foot and as a connector for toes 2. In this regard, the inner diameter of each bracket 7 is sized to slidably but closely engage a respective one of toes 2 therein for a firm friction fit.

Assembly of the holder is quickly and easily completed simply by inserting toes 2 into cooperating ones of brackets 7. One edge of liner's 15 open end is looped over one of flanges 6 with an opposing edge portion then looped over the flange of opposite frame member 5. The dimensions of most commercially available liners are such that when connected to the holder as described above, frames 5 are drawn together which biases flanges 6 against the contiguous portions of the liner. This tensioning holds the liner in a fully opened condition and also helps to firmly secure the liner to the holder without the use of extraneous clips or clamps even as the bag's load increases.

Bracket 7 can be made of tubular metallic stock. In wet or damp environments, the bracket will be subject to rusting and corrosion which can bind toes 2 in place to prevent disassembly. If the toes and brackets are different metals, galvanic reactions are also possible again resulting in corrosion and binding.

An alternate method of connecting the frames and base together is shown with reference to FIGS. 3 and 4 wherein metal brackets 7 are replaced with non-metallic brackets 30 snap fit to the corners of base 10. Each bracket, which can be made of plastic, nylon or any other corrosion-resistant material, consists of two orthogonally extending lozenges 29, with each lozenge having a pair of longitudinally extending apertures 32 and 33 formed therethrough.

Lower aperture 32 is slotted along its length as at 36 for a snap fit over the contiguous portions 13 of base 10. Upper aperture 33 is adapted for a sliding friction fit with respective ones of toes 2. Lozenges 29 are connected together such as by means of webs 38 and 39 made of the same material as the lozenges themselves for extrusion molding purposes. The use of brackets 30 not only minimizes rusting and corrosion, but permits attachment of frames 5 either from the left, as shown in FIG. 4, or from the right.

If preferred, base 10 can be a solid sheet material and flanges 6 can be formed with serrations or other surface etchings for enhanced connection to the liner. The side frames can be manufactured in different sizes for ordinary garbage bags or for the larger units useful for yard or other high volume waste.

Moreover, frames 5 need not necessarily be normally outwardly splayed. For example, base 10 can be elongated in the direction of arrow A (FIG. 1) with the frames extending either perfectly vertically or even with an inward splaying, so long as attachment of the liner causes biasing of the upper ends of the frames against the edges of the liner's opening. The frames themselves can adopt different configurations such as the variation shown in FIG. 5 wherein frame 40 is generally T-shaped. As well, frames 5 and base 10 can be formed as a single integrated unit that cannot be disassembled.

We claim:

1. Apparatus for holding a liner or bag in an open condition, comprising:

a ground engaging base member; and opposed frame members adapted to extend upwardly from said base member for supporting a liner therefrom, said frame members being sufficiently spaced apart that attachment of said liner causes biasing of liner-engaging portions of said frame members against said liner for tensioning same into an open condition, said liner-engaging portions of said frame members comprising an outwardly turned lip formed at an angle to said frame members to facilitate a detachment-resistant connection to a liner.

2. The apparatus of claim 1 wherein said frame members comprise a pair of frame members, each of which is adapted to extends upwardly from a respective opposite side of said base member.

3. The apparatus of claim 2 wherein each of said frame members includes at a lower end thereof a projection adapted for a detachable friction fit to connector means provided on said base member.

4. The apparatus of claim 3 wherein each of said frame members tapers upwardly and outwardly relative to said base member so that said frame members are normally splayed apart relative to one another for facilitating a tensioned connection to a liner.

5. The apparatus of claim 4, wherein said connector means comprise a tubular sleeve fixedly connected to said base member and adapted to slidably receive said projection on said frame member thereinto for a friction fit therewith.

6. The apparatus of claim 3, wherein said connector means comprise a tubular sleeve fixedly connected to said base member and adapted to slidably receive said projection on said frame member thereinto for a friction fit therewith.

7. Apparatus for holding a liner or bag in an open condition, comprising:

a ground engaging base member;

a pair of opposed frame members, each of which is adapted to extend upwardly from a respective opposite side of said base member, said frame members being sufficiently spaced apart that attachment of a liner thereto causes biasing of liner-engaging portions of each said frame member against said liner for tensioning the same into an open condition, each said frame member including at a lower end thereof a projection adapted for a detachable friction fit to connector means provided on said base member, said connector means comprising a bracket having a first slotted aperture for a snap fit to said base member and a second aperture to slidably receive said projection on said frame member thereinto for a friction fit therewith.

8. The apparatus of claim 7 wherein said bracket includes a pair of orthogonally,extending first slotted apertures for a snap fit to a corner of said base member.

9. The apparatus of claim 7 wherein said liner-engaging portions of said frame members comprise a lip formed at an angle to said frame members to facilitate a detachment-resistant connection to a liner.

10. Apparatus for holding a liner or bag in an open condition, comprising:

a ground engaging base member;

a pair of opposed frame members, each of which is adapted to extend upwardly from a respective opposite side of said base member, said frame members being sufficiently spaced apart that attachment of a liner thereto causes biasing of liner-engaging portions of each said frame member against said liner for tensioning the same into an open condition, each said frame member including at a lower end thereof a projection adapted for a detachable friction fit to connector means provided on said base member, said frame members tapering upwardly and outwardly relative to said base member so that said frame members are normally splayed apart relative to one another for facilitating a tensioned connection to the liner, said connector means comprising a bracket having a first slotted aperture for a snap fit to said base member and a second aperture to slidably receive said projection on said frame member thereinto for a friction fit therewith.

11. The apparatus of claim 10 wherein said liner-engaging portions of said frame members comprise an outwardly turned lip formed at an angle to respective ones of said frame members to facilitate a detachment-resistant connection to a liner.

* * * * *